United States Patent [19]

Coralli et al.

[11] 4,183,235

[45] Jan. 15, 1980

[54] PROTECTED PADLOCK

[75] Inventors: Giorgio V. Coralli; Alessandro Brunelli, both of Bologna, Italy

[73] Assignee: Viro Innocenti S.p.A., Zola Predosa, Italy

[21] Appl. No.: 886,502

[22] Filed: Mar. 14, 1978

[30] Foreign Application Priority Data

Mar. 14, 1977 [IT] Italy ..... 12510 A/77
Oct. 3, 1977 [IT] Italy ..... 12789 A/77

[51] Int. Cl.[2] ..... E05B 67/22
[52] U.S. Cl. ..... 70/34; 70/417
[58] Field of Search ..... 70/32, 33, 34, 23, 38 R, 70/38 A, 38 B, 38 C, 417

[56] References Cited

U.S. PATENT DOCUMENTS

| | | | |
|---|---|---|---|
| 1,792,403 | 2/1931 | Stone | 70/33 |
| 3,473,356 | 10/1969 | Niilola | 70/417 |
| 3,581,530 | 6/1971 | Respedori | 70/38 R |
| 3,605,461 | 9/1971 | Frank | 70/363 |
| 3,981,168 | 9/1976 | Corelli | 70/417 |

FOREIGN PATENT DOCUMENTS

| | | | |
|---|---|---|---|
| 2514920 | 10/1976 | Fed. Rep. of Germany | 70/471 |
| 485991 | 10/1953 | Italy | 70/34 |

*Primary Examiner*—Robert L. Wolfe
*Attorney, Agent, or Firm*—Jordan and Hamburg

[57] ABSTRACT

A padlock presents a straight shackle axially slidable in seats provided in two wings obtained in the padlock body, so as to be capable of closing a U-shaped recess defined by the said wings. The shackle is locked in its closure position by a latch pin the movement of which is controlled by the rotation of a cylinder of a cylinder lock of known type, housed in the padlock body. An armour jacket made of steel is vested onto the side surface of the padlock body, thus conferring to the padlock a protection against attempts of breaking open. The said armour jacket also serves for closing the bores for the pin tumblers and the bore for housing the latch pin, and of any other bore made in the side surface of the padlock body for housing the components of the padlock mechanism.

7 Claims, 10 Drawing Figures

PROTECTED PADLOCK

BACKGROUND OF THE INVENTION (1) Field of the Invention

The present invention relates to padlocks, and more particularly to padlocks presenting at least one straight shackle slidable in seats provided in at least two wings obtained in the padlock body, so as to be capable to close a U-shaped recess defined by the said wings. The shackle is locked in its closure position by a latch pin the movement of which is controlled by the rotation of a cylinder of a cylinder lock of known type, housed in the padlock body.

(2) Statement of the Prior Art Known

The following prior art is known to the applicants:

U.S. Pat. No. 3,581,530 (RASPADORI) the whole document.

U.S. Pat. No. 3,981,168 (VANELLI CORALLI et al) the whole document.

SUMMARY OF THE INVENTION

The invention relates to an improvement in the padlocks of the type referred to, in which the side surface of the padlock body (which is usually made of brass) is vested with an armour jacket made of hard material, usually hardened steel, thus conferring to the padlock a protection against any attempts of breaking open. Moreover, the armour jacket serves for closing the bores obtained in the padlock body for the housing of the tumbler pins and of the latch pin controlling the movement of the shackle. Consequently, the adoption of the said armour jacket, besides conferring a protection to the padlock, renders unnecessary the operations of plugging the said bores with plugs made of brass and of concealing the said plugs by means of smoothing and polishing operations. Protective armour plates may be provided also in correspondence of the two front surfaces of the padlock.

According to further embodiments of the invention, a protected padlock of the above mentioned type is provided, in which a single shackle serves for the closure of two U-shaped recesses, or two independent shackles are provided, one for each recess, thus permitting the partial opening of the padlock, which is used, for example, for closing the two end links of a chain.

The above and other characteristic features of the padlock according to the invention, and the advantages deriving therefrom will appear evident from the following description of some preferred embodiments of same, made with reference to the Figures of the attached drawings.

DESCRIPTION OF THE PREFERRED EMBODIMENT

Figure 1:
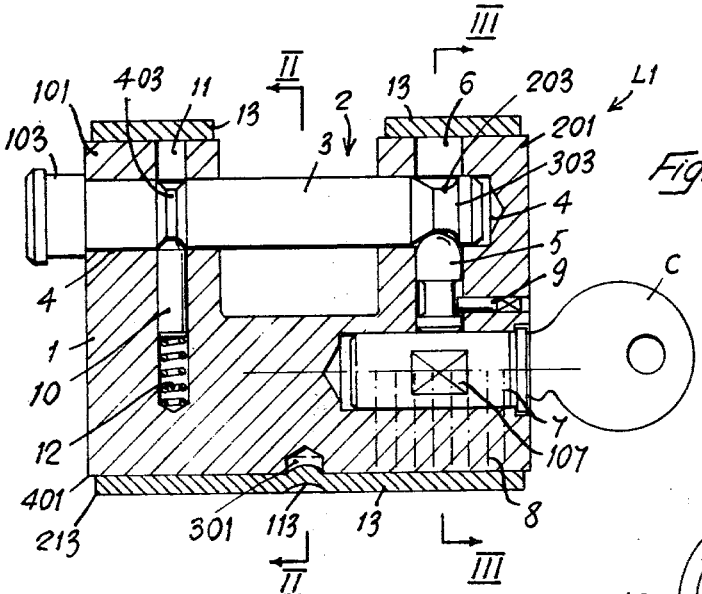
FIG. 1 shows a first embodiment of the padlock, sectioned longitudinally and in its closed condition.
Figure 3:
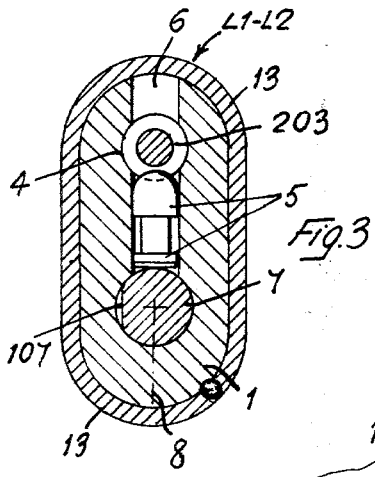
FIGS. 2 and 3 are sections of the padlock of FIG. 1, taken respectively along lines II—II and III—III of FIG. 1.
Figure 2:
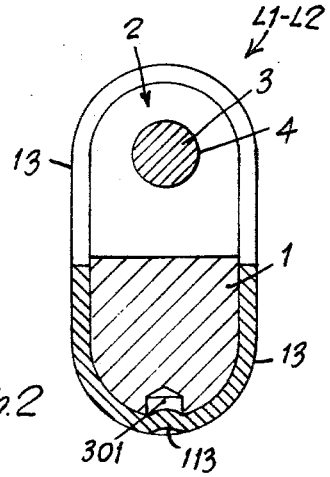

Referring firstly to FIGS. 1, 2 and 3, it is noted that the padlock L1 comprises a body 1 made of brass or other suitable material, with a transverse section which is substantially ellipsoidal. The body 1 is provided with an intermediate recess 2 through which passes the straight bolt-shaped steel shackle 3, which is slidable at the interior of aligned seats 4 obtained in the wings or arms 101, 201 which define the above mentioned recess. The shackle presents for its operation an enlarged head end 103 which abuts against the front end of the body 1, while at the other end the shackle is provided with an annular groove 203 which, when the padlock is in its closed condition, is radially engaged by the rounded head of a latch pin 5 which is slidable at the interior of a bore 6 of body 1 and bears on the rotatable cylinder 7 of a safety lock of any known type, which is also housed within body 1. The dash-and-dot lines 8 diagrammatically indicate the pin tumblers of the said safety lock.

By inserting into cylinder 7 the key C and by rotating said cylinder, a recessed portion 107 of the cylinder is brought in correspondence of the latch pin 5, so that the said pin can move away from the shackle and permit the axial movement of same for opening the padlock. For practical reasons, the movement of the latch pin 5 is limited by a radial pin 9. In order to avoid the complete sliding out of the shackle from the seats 4, during the opening of the padlock, the groove 203 of same is engaged by a pin 10 which is slidable at the interior of bore 11 of body 1 and is urged by a spring 12. Also for this purpose, the right-hand side 303 of the said groove 203 presents a sufficiently sharp edge.

In order to facilitate the closing of the padlock, and to avoid that the user must keep the shackle pushed while turning the key C, a provision has been made so that the shackle be axially blocked in its closure position, this being obtained by the said pin 11 which radially engages an annular intermediate groove 403 of the shackle itself.

According to the manufacturing techniques presently in use, normally, after the mounting and assembly of the various components at the interior of the padlock body 1, the free ends of the bores 6 and 11, and the ends of the bores containing the pin tumblers 8 of the safety lock, are plugged by using plugs made of brass, which are subsequently concealed by a smoothing and polishing operation of the whole side surface of the padlock.

The above mentioned finishing operations are eliminated by the improved protected padlock according to the invention, in which, after the mounting and assembly of the mentioned components, such as pin tumblers, latch pin and others, the side surface of the padlock body 1 is snugly vested by an armour jacket 13 presenting a suitable thickness, made of cemented hardened steel. With this improvement, the padlock presents increased qualities of resistance to attempts of breaking open by means of drills or other tools, without a remarkable increase in its production costs, since the cost of manufacture and assembly of the protection or armour jacket 13 is partly compensated by the elimination of the above mentioned finishing operations.

The protection jacket 13 is substantially tubular and may be inserted onto the body 1 with a tight snug fit, or may be blocked in position by means of a localized protuberance or swell 113, in view of which the body 1 presents a suitable recess 301. The dimensions in length of the protection jacket are preferably differentiated with respect to the dimensions of the body 1, so that the composite padlock body presents a double edge, as indicated with reference numerals 213 and 214, and consequently no chamfering operation is required.

Figure 4:
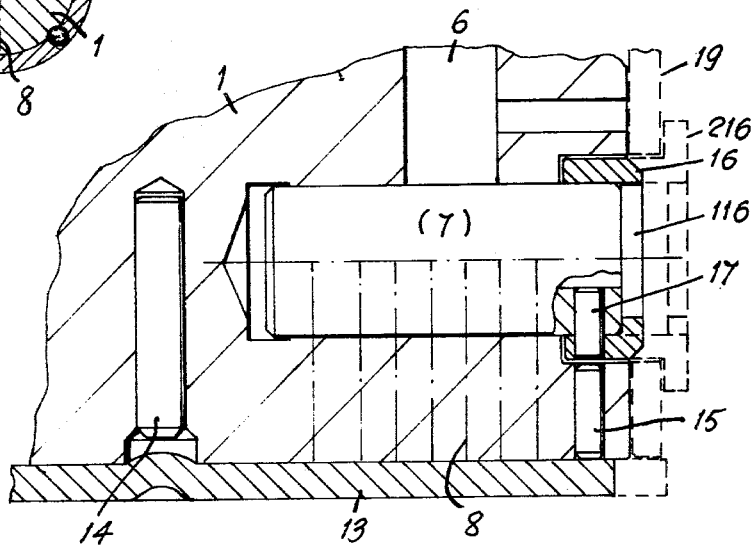
FIG. 4 shows, in enlarged scale and with parts in section, a detail relating to a further embodiment of the invention.

In order to further increase the resistance of the padlock against attempts of breaking open by means of a drill, there can be also provided for the housing of two steel pins 14, 15 in the body 1, said pins being arranged in correspondence of the extremities of the rows of tumbler pins of the safety lock (see FIG. 4), and also the outer end of the rotating cylinder 7 may be protected, by means of a cover 16 made of cemented hardened steel, keyed for example to the said cylinder by means of a pressure pin 17 and provided on its outer face with a slot 116 for permitting the passage of just the stem of the key.

MODIFICATIONS

Still a more effective protection of the padlock may be obtained also without the use of inner steel pins 14, 15 (FIG. 4), by arranging, in correspondence of the front surfaces of the body 1, the plates 18, 19 of cemented hardened steel (see FIG. 5), suitably shaped and precision fitted onto the extremities of the protection jacket 13, which extremities of the jacket are constructed projecting out of the body 1.

Figure 5:
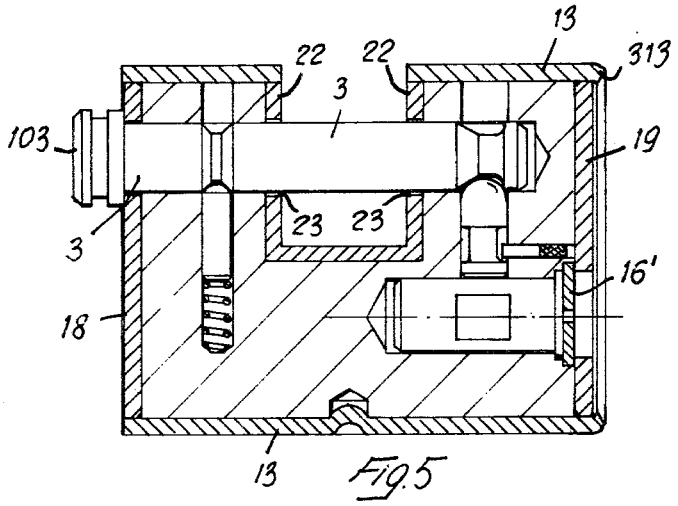
FIG. 5 shows in longitudinal section still another embodiment of the invention.
Figure 6:
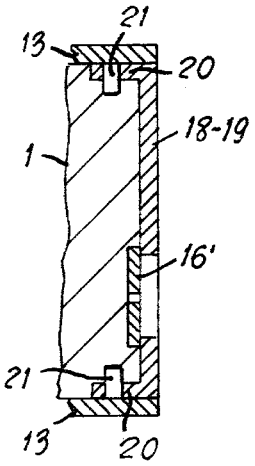
FIG. 6 shows in section a detail of still another embodiment of the invention.

Of the two front plates, plate 18 is in any case secured in position by the enlarged head end 103 of the shackle, while the other plate 19 cannot slide out due either to an annular flange 216 of the cover 16 (as shown by dash lines in FIG. 4) or by the inwardly directed edge 313 of the extremity of the jacket, as shown in FIG. 5, in which case the protection cover of the cylinder 7 may be limited to a simple front disc 16'. In the embodiment according to FIG. 6, the plate is provided with inward projecting parts 20 which are anchored to the body 1 by means of pins 21, the whole being afterwards blocked by the protection jacket 13. The solution indicated in FIG. 6 is also valid, obviously, for plate 18. In order to obtain a complete protection or greater strength of the padlock, prior to the fitting of the jacket 13, in the recessed portion 2 there may be fitted the U-shaped steel plate 22 provided with bores 23 for permitting the passage of the shackle.

Still another object of the present invention is to provide a protected padlock presenting a straight shackle, particularly adapted for being used with chains, closure rings, or the like, which require the presence of two anchoring points in the padlock. For such a type of padlock it is required that one of the two anchoring points can be easily associated, by the user of the padlock, to one end of the chain, and that same can be disconnected from the said end by means of a supplementary operation which can be effected only when the padlock is in open condition.

Figure 7:
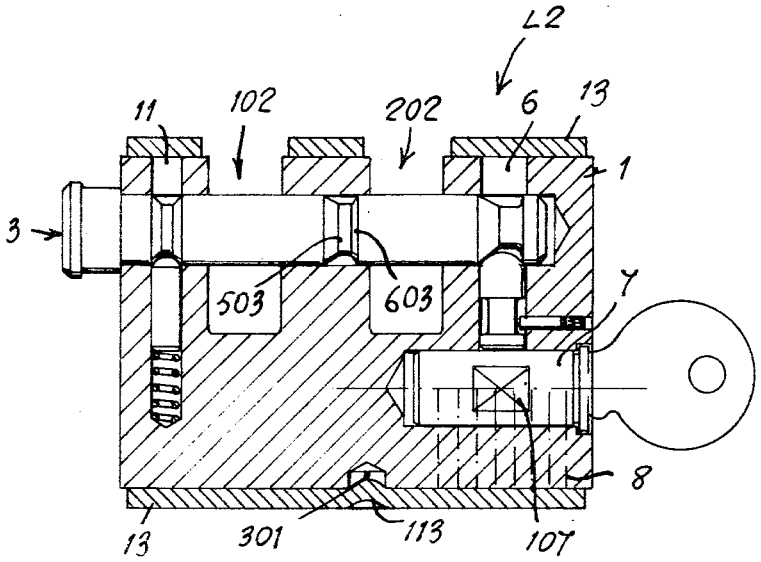
FIGS. 7, 8, 9 and 10 show in longitudinal section as many different embodiments of a padlock according to the invention, presenting two U-shaped recesses which provide for two separate anchoring points.

Referring to FIG. 7, there is illustrated a padlock L2 which is characterized by the provision of two side recesses 102, 202, through which passes a common shackle 3 which is provided with a further intermediate annular groove 503 presenting a side 603 with a sharp edge which, in its cooperation with the spring-urged pin 10, avoids the sliding of the shackle out of the recess 102, thus permitting to steadily anchor to the padlock one end of the chain.

The solutions indicated by reference letters L3 and L4 (FIGS. 8 and 9) are more simplified and functional. Both of them are different from the solution of FIG. 7 due to the fact that the shackle is divided into two shackle parts of which the one indicated by 3' is controlled by the safety lock with piston 5 arranged in the median part of the padlock body, and consequently with greater protection, while the other part 3'' of the shackle, to which there is anchored steadily one end of the chain to be closed, may be axially shifted towards the left only when the shackle 3' is shifted out (open padlock) and with a supplementary operation which is directed to the disengagement of a reduced-section and threaded end 703 (FIG. 8) or of a conical end 803 (FIG. 9) of the said part 3'' of the shackle, respectively from seats 501 and 601 of body 1.

Figure 10:
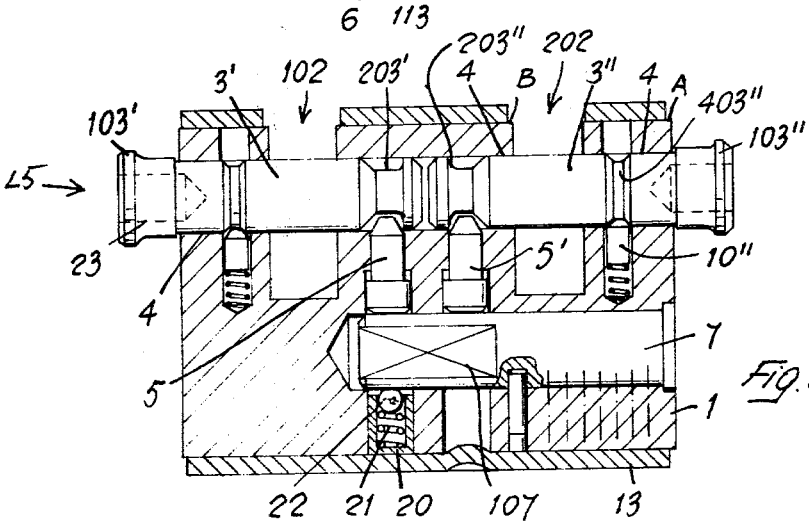

In the embodiment shown in FIG. 10, the padlock L5 presents two independent shackles 3' and 3'' which are axially slidable in aligned seats obtained in the body 1. As it can be clearly appreciated from the drawing, the cylinder 7 presents a greater length, so that through its recessed portion 107, the two shackles 3' and 3'' can be axially blocked, respectively by latch pins 5 and 5', of which the pin 5' engages an annular groove 203'' of the shackle 3''. Also the shackle 3'' is provided with an annular groove 403'' which avoids its complete sliding out of the padlock body, by cooperating with the spring-urged pin 10''.

Figure 8:
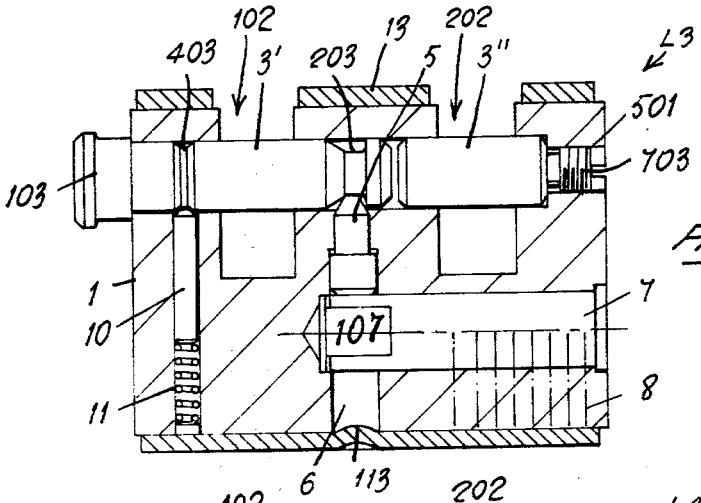
Figure 9:
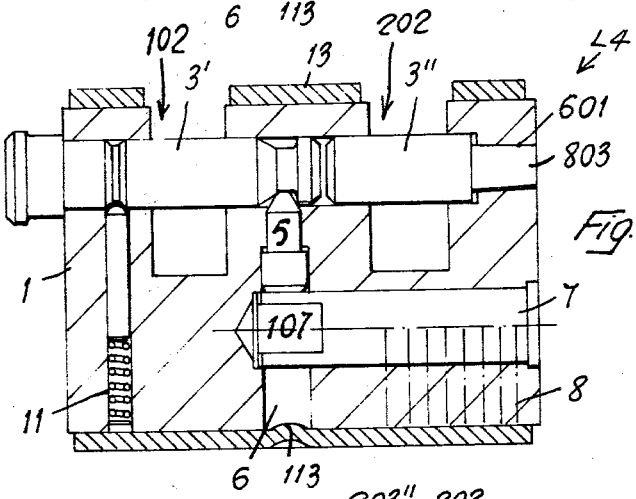

In the protected padlock according to FIG. 10 it is therefore avoided any possibility of breaking open of the padlock itself by attempting to detach for example the wing A from the guide seat in the central wing B, with consequent simple sliding out of the inner end of the shackle 3'' from the said guide seat in the central wing B, which instead could be possible in the embodiments shown in FIGS. 8 and 9.

In the embodiment shown in FIG. 10 the padlock comprises two shackles 3' and 3'' which are axially slidable in suitable aligned seats 4 obtained in the body 1. Said body, together with jacket 13, presents two recesses 102, 202, in which the end links of the chain can be anchored with minimum clearance to said shackles 3', 3''. In the solutions according to the main patent, one only of the said shackles, and more precisely shackle 3' can be blocked axially in its seat thanks to the cylinder 7 of the safety lock housed in the body 1, said cylinder being provided with an eccentric portion 107 which controls a pin 5 which on its turn cooperates with an annular recess or groove 203' of the said shackle.

Into one of the two bores 6 serving for the insertion of the latch pins 5, there can be mounted a capsule element 20 which contains spring means 21 which elastically urge a ball 22 or any other member in the direction of the cylinder 7, in order to stabilize same in its two positions of rotation.

The outer enlarged ends 103', 103'' of the two shackles, may be provided with an axial recess 23 having weakening purposes, so that the said ends can break with a certain easiness, if they are bent or compressed under the action of tools used by thieves.

It is understood that to the improved protected padlock as described there can be brought numerous changes, in particular from the constructive viewpoint, the whole without departing from the leading principle of the invention, as described above and as claimed hereafter.

We claim:

1. A protected padlock, of the type presenting at least one straight shackle slidable in seats provided in at least two wings of the padlock body so as to be capable of closing a U-shaped recess defined by the said wings, and a cylinder lock comprising a cylinder rotatably housed in the said padlock body and acting on a latch pin housed in a bore provided in the padlock body, said cylinder cooperating with pin tumblers housed in bores provided in the said padlock body, wherein the improvement comprises an armour jacket made of hard material which is vested onto the side surface of the padlock body so as to close the said latch pin bore and the said pin tumblers bores, while realizing an outer protective casing for the padlock, said armour jacket being tubular and presenting a section which is substantially equal to the outer profile of the side surface of the padlock body, said armour jacket being blocked on the padlock body by means of an inwardly directed protuberance obtained on the said jacket and cooperating with a recess provided in the padlock body, by penetrating into same.

2. A protected padlock according to claim 1, in which a protective pin made of hard material is arranged in correspondence of at least one end of the row of pin tumblers of the cylinder lock, said protective pin being housed in a bore obtained in the padlock body, which bore is closed by the said armour jacket.

3. A protected padlock according to claim 1, in which front plates are arranged in correspondence of the end portions of the tubular jacket, to protect the front surfaces of the padlock body.

4. A protected padlock according to claim 1, presenting two U-shaped recesses defined by three wings of the padlock body, and a single straight shackle which is capable of closing both said U-shaped recesses.

5. A protected padlock according to claim 1, in which the end of the shackle which projects out of the padlock body presents an axial recess having weakening purposes.

6. A protected padlock, of the type presenting two U-shaped recesses defined by three wings of the padlock body, a cylinder lock comprising a cylinder rotatably housed in the said padlock body and acting on a latch pin housed in a bore provided in the padlock body, said cylinder cooperating with pin tumblers housed in bores provided in the said padlock body, a first shackle axially slidable to close one of said recesses, said first shackle being controlled by a latch pin operated by the cylinder lock, and a second shackle co-axial to the first shackle and intended to close the other recess, said first and said second shackle being arranged, in the closed condition of the padlock, in end-to-end relationship, whereby in order to move the second shackle to free its recess, it is necessary to preliminarily move the first shackle to its open position, wherein the improvement comprises an armour jacket made of hard material which is vested onto the side surface of the padlock body so as to close the said latch pin bore and the said pin tumblers bores, while realizing an outer protective casing for the padlock.

7. A protected padlock according to claim 6, in which said cylinder also acts on a second latch pin housed in a second bore provided in said padlock body, movement of the shackles for opening of the recesses taking place in opposite directions.

* * * * *